US005205769A

United States Patent [19]

Mahonski et al.

[11] Patent Number: 5,205,769

[45] Date of Patent: Apr. 27, 1993

[54] METHOD OF MAKING A LAMP WITH AN INTERNALLY PRESSED FUSE

[75] Inventors: Christopher E. Mahonski, Winchester; Raymond T. Fleming, Lexington, both of Ky.

[73] Assignee: GTE Products Corporation, Danvers, Mass.

[21] Appl. No.: 930,073

[22] Filed: Aug. 14, 1992

[51] Int. Cl.[5] ..... H01J 9/32

[52] U.S. Cl. ..... 445/27

[58] Field of Search ..... 445/27; 65/59.26; 313/332

[56] References Cited

U.S. PATENT DOCUMENTS

| | | | |
|---|---|---|---|
| 3,077,022 | 2/1963 | Cullis, Jr. | 445/27 |
| 3,274,426 | 9/1966 | Scoledge et al. | 313/332 X |
| 3,346,768 | 10/1967 | Patsch | 313/332 X |
| 3,549,933 | 12/1967 | Smalley | 313/318 X |
| 3,710,169 | 1/1973 | T'Jampens et al. | 313/331 X |

*Primary Examiner*—Kenneth J. Ramsey
*Attorney, Agent, or Firm*—William E. Meyer

[57] ABSTRACT

A method of making a press sealed lamp with an internally pressed fuse is disclosed. The filament structure is conveniently formed so the fuse links across a looped section of the initial filament structure. The loop structure provides strength to the fused filament structure prior to sealing. After the lamp is sealed, a portion of the exposed loop is trimmed, thereby limiting the remaining electrical connection to the path through the fuse.

3 Claims, 3 Drawing Sheets

METHOD OF MAKING A LAMP WITH AN INTERNALLY PRESSED FUSE

TECHNICAL FIELD

The invention relates to electric lamps and particularly to methods of making press sealed electric lamps. More particularly the invention is concerned with a method of making a lamp with a fuse internally press sealed in the press seal.

BACKGROUND ART

An incandescent lamp may fail when the filament breaks. If there is sufficient voltage applied, and there is sufficient atmosphere in the lamp, an uncontrolled arc may develope between the broken ends of the filament. The arc can cause the lamp to overheat, or break. To prevent an arcing failure, lamps may include a fuse to fail and cut off the arc. Presently press sealed lamps are fused by attaching a fuse nickel to the exterior end of the lead. The final contact point, such as a button contact, is then welded or crimped to the fuse. The fuse is small, and not easily attached in proper alignment. Welding the fuse to the button contact may further misalign the end connector. The result is a fused lamp with an offset, twisted or otherwise misaligned contact. The lamp then does not fit well in the lamp fixture, or makes a poor connection with the fixture contacts. When the lamp is coupled in the fixture, the poor contact alignment may cause the filament to be displaced from its expected optical position, thereby upsetting the lamp and fixture optics. There is then a need for a fused lamp with regular alignment.

The fuse is commonly a thin wire that is easily bent, and sometimes broken. It can therefore be difficult to make a proper weld to a thin fuse wire. The weld contact may not be made initially, or it make be broken in subsequent processing or use of the lamp. One know solution is to use an inner ceramic that locates and supports the fuse, but the extra ceramic piece requires separate manufacture, separate installation, and can be a separate source of manufacturing problems. The inner ceramic and its problems necessarily cost money to accommodate. There is then a need for a lamp design that protects the fuse from movement, and the possibility of misalignment, and breakage, and preferably one that is both simple and reliable. There is then a need for a lamp with internally pressed fuse.

Examples of the prior art are shown in the following U.S. patents.

U.S. Pat. No. 3,274,426 issued to R. F. Scoledge on Sep. 20, 1966 for Electric Lamp with Fuse shows a press sealed lamp with a fuse attached to the lead outside the press seal. The fuse is then enclosed by a ceramic end cap, and button contact structure.

U.S. Pat. No. 3,346,768 issued to G. F. Patsch on Oct. 10, 1967 for Incandescent Lamp with a Fuse Integral with the Lead in Structure shows a press sealed lamp with a fuse attached to the lead outside the press seal. The fuse is then enclosed by a ceramic end cap, and button contact structure. The fuse is entrained in the cement supporting the ceramic end cap.

U.S. Pat. No. 3,549,933 issued to John F. Smalley on Dec. 22, 1967 for Quartz Lamps shows a press sealed lamp with a looped outer lead extending from the seal foil. The loop is untrimmed, and no fuse is included in the lamp.

U.S. Pat. No. 3,710,169 issued to Germain R. T' Jampens on Jan. 9, 1973 for Halogen Filament Lamp Having an Internal All Protection Arrangement shows a press sealed lamp with a rod embedded on the inner side of the seal foil to which the filament coil is attached. The embedded rod is said to provide a better fuse if the coil should break and the lamp move to an arc condition.

DISCLOSURE OF THE INVENTION

A lamp with an internally pressed fuse may be formed by following the steps of first forming an envelope with an internal surface defining an enclosed volume, and forming a filament structure having a filament coupled through a first end to an inner lead that couples to a fuse that couples to a first outer lead, wherein the inner lead is additionally mechanically coupled to the first outer lead. The formed filament is additionally coupled through a second end to a second outer lead. The filament structure is positioned in the envelope with at least a portion of the first outer lead, and at least a portion of the mechanical connection between the inner lead and first outer lead extending to the exterior of the envelope, and a portion of the second outer lead extending to the exterior of the envelope. The envelope is then press sealed to seal the filament in the enclosed volume, and sealing the fuse in the press seal, leaving at least a portion of the first outer lead, and at least a portion of the connection between the inner lead and first outer lead exposed on the exterior of the envelope, and leaving a portion of the second outer lead exposed on the exterior of the envelope. The connection between the inner lead and first outer lead is then divided to electrically separate the first outer lead, while leaving the inner lead connected to the fuse and the fuse connected to the first outer lead.

BEST MODE FOR CARRYING OUT THE INVENTION

Figure 1:
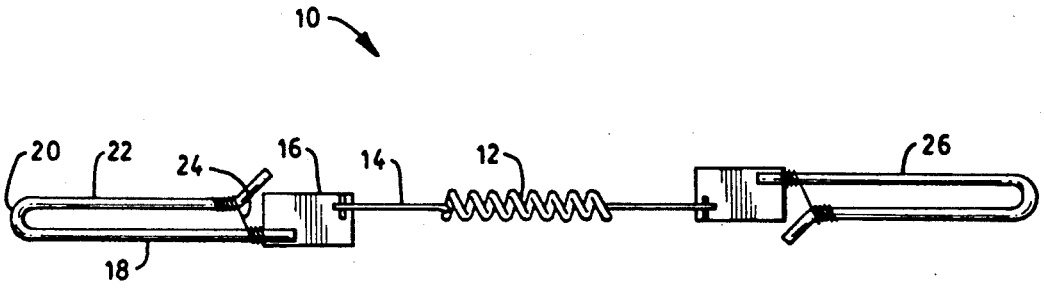
FIG. 1 shows a fused filament structure.

FIG. 1 shows a fused filament structure 10. The fused filament structure 10 includes a filament 12, an inner lead 14, a seal foil 16, an outer lead 20, and a fuse 24. The filament 12 may be any convenient filament, such as a coiled coil or coiled coiled coil. The preferred filament 12 is a coiled coil, axially aligned with connections formed at the axial ends of the filament. Filaments are commonly formed from tungsten wire, and the formation process is well known in lamp making arts. The filament 12 is then electrically coupled to an inner lead 14. The preferred inner lead 14 is a straight section of molybdenum wire. The outer end of the filament 12 may be welded, crimped or otherwise coupled to the inner end of the inner lead 14. The outer end of the inner lead 14 may then be electrically coupled to the seal foil 16. Seal foils 16 are commonly thin molybdenum sheets used to seal with quartz envelopes. Where the envelope is made of glass, the inner lead 14 may extend directly through the press seal as the outer lead 20, and the intermediate seal foil 16 may be eliminated (see FIG. 6). The outer end of the inner lead 14 and the inner end of the seal foil 16 are usually welded to form a mechanical and electrical connection. The outer end of the seal foil 16 is in turn electrically coupled the inner end 18 of the outer lead 20. The outer lead 20 may again be a molybdenum wire, welded to the outer end of the seal foil 16. The preferred outer lead 20 extends away from the filament 12 and seal foil 16 a distance sufficiently far to be exposed on the exterior of the lamp envelope after the filament structure 10 is pressed in the lamp. It is convenient that the outer lead 20 extend even farther beyond where the press seal end will be, to create a useful exposed outer lead 20 length. The preferred outer lead 20 is thereafter bent back towards the filament 12, so the outer end 22 of the outer lead 20 is parallel with but offset from the inner end of the outer lead 20. The inner end 18 of the outer lead 20 and the electrically outer end 22 of the outer lead 20 are then side by side, but offset from each other. The outer end 22 of the end of the outer lead 20 is additionally offset sufficiently from the seal foil 16 so as to not electrically short circuit, or cause electrolysis of the glass between the outer end 22 of the outer lead 20 and the seal foil 16. Welded, crimped or otherwise electrically connected between the inner end 18 of the outer lead 20 and the bent back outer end 22 of the outer lead 20 is the fuse 24. The fuse may be a wire made of tungsten, molybdenum or similar material capable of retaining its form while being press sealed in molten glass or quartz. The fuse 24 may be wrapped or welded between the outer lead 20 ends 18, 22, and offset from the seal foil 16 so as to not provide a short circuit between the seal foil 16 and the outer end 22 of the outer lead 20. The fuse 24 is positioned sufficiently closed to the seal foil 16, to be completely entrained in the press seal region of the finally formed lamp. The fuse 24 is then linked between an inner connection to the filament and an adjacent outer connection that extends only into what will be the press seal region. It is convenient that the inner connection extend exteriorly beyond the connection to the fuse to be mechanically linked to the outer connection, thereby strengthening the filament structure during assembly. A similar inner lead, seal foil, outer lead and fuse structure may be formed on the opposite end (second end) of the filament structure 10. Alternatively, no second fuse need be welded or wrapped in place on the second outer lead 26. The hooked back, or looped portion of the first outer lead 20, between the inner end 18, and outer end 22 is convenient for grasping, and locating in assembly line manufacture, so the preferred embodiment includes a hooked back second outer lead 26.

Figure 2:
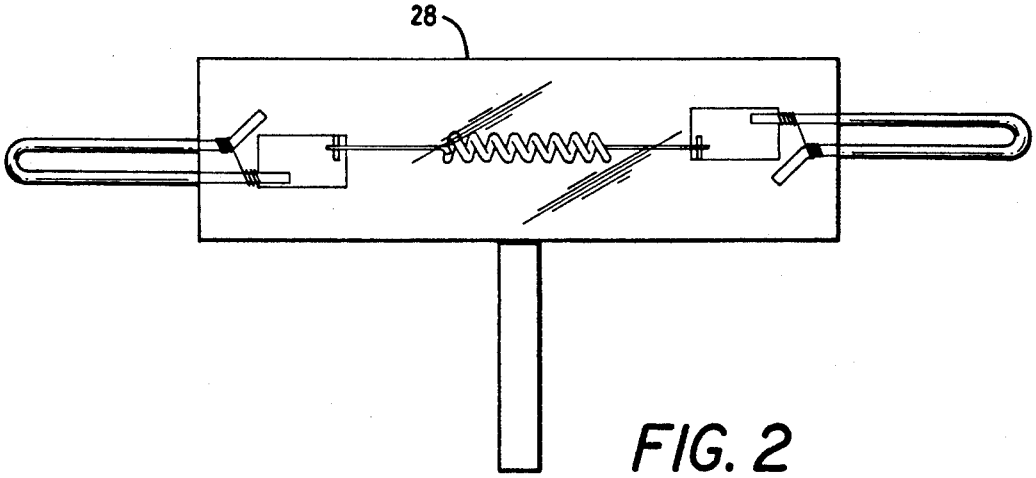
FIG. 2 shows a fused filament structure positioned in a tubulated lamp blank.
Figure 3:
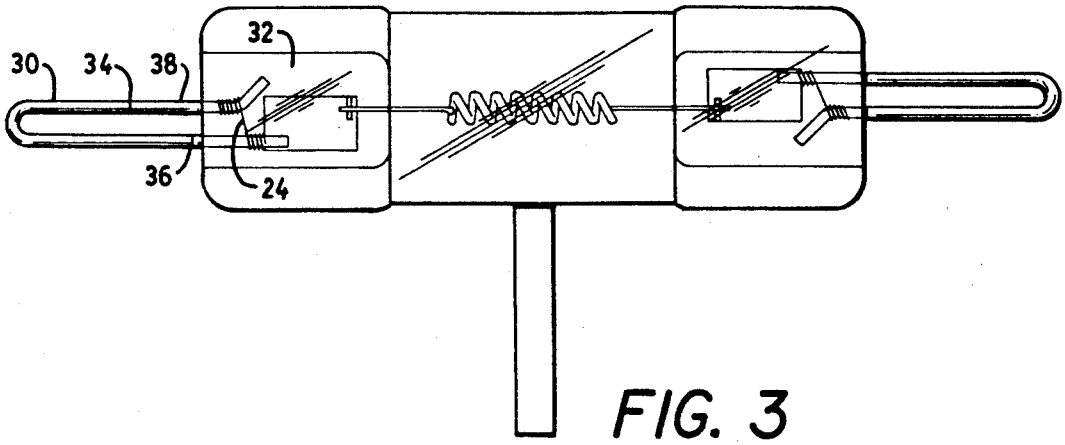
FIG. 3 shows a fused filament structure after being pressed in a lamp blank.

FIG. 2 shows a fused filament structure 10 positioned in a lamp blank 28. The envelope blank 28 may be formed from quartz or glass. The Applicant prefers a tubulated quartz cylinder having a length that covers somewhat exteriorly from the where first outer lead 20 is wrapped to the fuse 24, to a point along the second outer lead 26, where the second outer lead wire ends lie adjacent. With the outer lead ends of the filament structure held securely, the tubulation may be positioned opposite the filament 12. The quartz or glass envelope blank 28 may then be heated and press sealed around a portion of the inner lead 14, the seal foil 16, a portion of the inner end 18 of the outer lead 20, a portion of the second end 22 of the outer lead 20, and the fuse 24. The second end of the envelope may then be similarly heated and press sealed to the second end of the filament structure 10. The volume enclosed by the envelope blank may be appropriately filled with a fill gas and any appropriate dopants, through the tubulation, which is then sealed. Alternatively, no tubulation is necessary, and the fill gases or dopants may be added through the second end of the envelope blank 28 which is then closed and sealed to the second end of the filament structure 10. The filament structure 10 is then captured in the press seals, with a looped end of the first outer lead 20 exposed on the exterior of the lamp. The seal foil 16 and fuse 24 are completely captured in the press seal of the lamp. The outer end of the inner lead 14 and the portions of the inner end 18 and the outer end 22 of the outer lead 20 are captured in the press seal. FIG. 3 shows a fused filament structure 10 pressed in a lamp blank 28.

Figure 4:
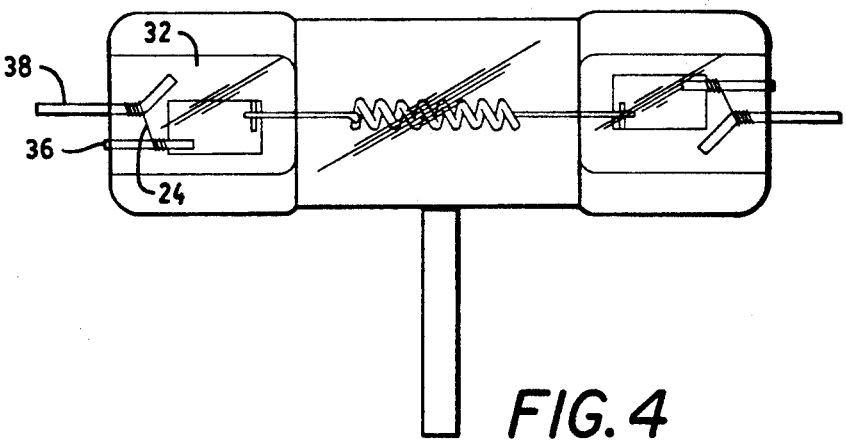
FIG. 4 shows a fused filament structure pressed in a lamp blank after being rimmed.

The looped end 30, exposed on the exterior of the press seal 32 of the outer lead 20 may then be trimmed. The mechanical strengthening provided by the connection of the inner connection linked around the fuse 24 to the outer connection is now no longer needed and may be trimmed. In the preferred embodiment, the inner end 18 of the outer lead 20 is trimmed adjacent the axial, outer edge of the press seal 32 (see point 34), thereby leaving little or none of the inner end 18 of the outer lead extending from the envelope. The amount extending beyond the press seal is sufficiently short to avoid mechanical interference, or casual electrical contact. Lead 20 is similarly trimmed at a convenient distance offset from the axial, outer edge of the press seal (see point 36), thereby leaving a single protruding wire stud 38 extending axially from the press seal 32. The wire stud 38 is trimmed to be sufficiently long to make a further electrical or mechanical coupling. FIG. 4 shows a fused filament structure pressed in a lamp blank after being trimmed. The filament 12 is then electrically coupled through the fuse 24 to stub 38 exposed on the exterior of the lamp.

Figure 5:
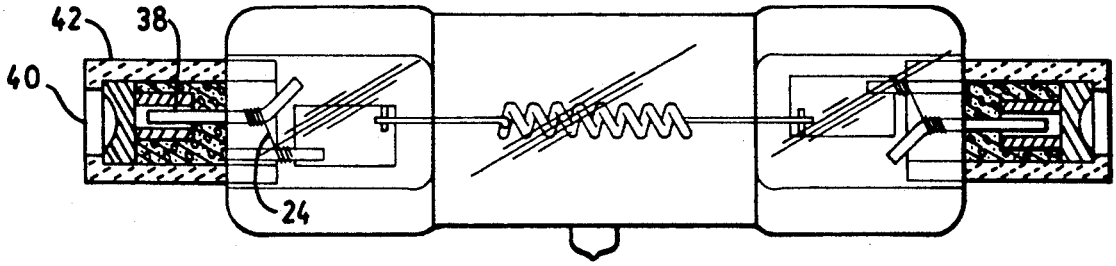
FIG. 5 shows a preferred embodiment of a lamp with internally pressed fuse.

FIG. 5 shows a cross sectional view of a preferred embodiment of a lamp with internally pressed fuse 24. With the outer lead 20 trimmed, appropriate contacts, shields, and outer end coupling features may be conveniently added. In the preferred embodiment, a contact button 40 is welded or crimped to the outer end of the outer lead 20. A ceramic sheath 42 is then cemented in place around the contact button 40, abutting the end of the press seal 32. No inner ceramic is necessary to align the fuse, since the fuse is held in place in the press seal. In the final form of the preferred embodiment, the fuse 24 is completely captured in the press seal 32, and the only electrical path to the filament 12 is through the fuse 24.

Figure 6:
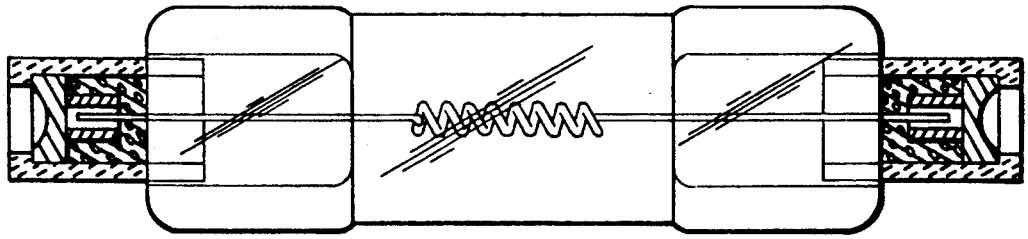
FIG. 6 shows an alternative preferred embodiment of a lamp with internally pressed fuse, without a seal foil.

FIG. 6 shows an alternative preferred embodiment of a lamp with internally pressed fuse, without a seal foil. Press sealed lamps may be made with glass, and not require a seal foil. FIG. 6 also shows the first outer lead with a wrapped fuse, while the second outer lead has no fuse.

In a working example, some of the dimensions were approximately as follows: The test lamp was designed as a 150 watt, 25 volt, double ended press sealed lamp. The envelope was made of quartz, and had a width of 1.27 centimeter (0.5 inch). The filament structure had a coiled coil, molybdenum filament, a molybdenum inner lead, a molybdenum seal foil, a molybdenum outer lead, and a molybdenum fuse. The end to end distance between the outer ends of the inner leads was about 32 millimeters (1.25 inch). The overall distance between the outer ends of the outer leads was about 83.3 millimeters (3.28 inch). The outer lead had a diameter of 0.076 centimeter (0.03 inch). Molybdenum fuses with diameters of 0.1524, 0.1778, 0.2032 millimeters (0.006, 0.007, 0.008 inch) were tested. With the above working examples, sixteen lamps were subjected to 120 volts provided by a stiff, line power supply. The fuses failed within the necessary time and amperage conditions of operations. The fuses on failing did not cause the seal to shatter, or break. Damage around the fuse did occur with some material expelled in the direction of the ceramic sheath. The expelled material, appeared to be safely contained within the ceramic sheath.

The disclosed dimensions, configurations and embodiments are as examples only, and other suitable configurations and relations may be used to implement the invention. While there have been shown and described what are at present considered to be the preferred embodiments of the invention, it will be apparent to those skilled in the art that various changes and modifications can be made herein without departing from the scope of the invention defined by the appended claims.

What is claimed is:

1. A method of forming a lamp with an internally pressed fuse comprising the steps of:

a) forming an envelope with an internal surface defining an enclosed volume, b) forming a filament structure having a filament coupled through a first end to an inner lead that couples to a fuse that couples to a first outer lead, wherein the inner lead is additionally mechanically coupled to the first outer lead, the filament being coupled through a second end to a second outer lead, c) positioning the filament structure in the envelope with at least a portion of the first outer lead, and at least a portion of the mechanical connection between the inner lead and first outer lead extending to the exterior of the envelope, and a portion of the second outer lead extending to the exterior of the envelope, d) press sealing the envelope to seal the filament in the enclosed volume, and sealing the fuse in the press seal, leaving at least a portion of the first outer lead, and at least a portion of the mechanical connection between the inner lead and first outer lead exposed on the exterior of the envelope, and leaving a portion of the second outer lead exposed on the exterior of the envelope, e) dividing the connection between the inner lead and first outer lead to electrically separate the outer lead, while leaving the inner lead connected to the fuse and the fuse connected to the outer lead.

2. The method in claim 1, wherein the inner lead and outer leads are initially portions of the a single wire, with the fuse coupled therebetween.

3. A method of forming a lamp with an internally pressed fuse comprising the steps of:

a) forming an envelope with an internal surface defining an enclosed volume, b) forming a filament structure having a filament coupled to an inner lead that couples to a fuse that couples to a first outer lead, wherein the inner lead extends exteriorly beyond the connection point with the fuse and then loops back towards the filament to form the first outer lead, the filament being additionally coupled through a second end to a second outer lead, c) positioning the filament structure in the envelope with at least a portion of the outer lead, and positioning at least a portion of the looped portion of the inner lead connected between the inner lead and first outer lead to extend to the exterior of the envelope, and positioning a portion of the second outer lead to extend to the exterior of the envelope, d) press sealing the envelope to seal the filament in the enclosed volume, and sealing the fuse in the press seal, leaving at least a portion of the outer lead, and at least a portion of the loop connection between the inner lead and the first outer lead exposed on the exterior of the envelope, and leaving a portion of the second outer lead exposed on the exterior of the envelope, e) dividing the loop connection between the inner lead and first outer lead to electrically separate the first outer lead, while leaving the inner lead connected to the fuse and the fuse connected to the first outer lead.

* * * * *